US005202859A

United States Patent [19]

Gorai

[11] Patent Number: 5,202,859

[45] Date of Patent: Apr. 13, 1993

[54] TIME INFORMING CLOCK

[75] Inventor: Yuji Gorai, Tokyo, Japan

[73] Assignee: Seikosha Co., Ltd., Japan

[21] Appl. No.: 650,483

[22] Filed: Feb. 5, 1991

[30] Foreign Application Priority Data

Feb. 6, 1990 [JP] Japan ..... 2-10687[U]

[51] Int. Cl.[5] ..... G04B 21/00

[52] U.S. Cl. ..... 368/274; 368/272

[58] Field of Search ..... 368/75, 251-274

[56] References Cited

U.S. PATENT DOCUMENTS

| | | | |
|---|---|---|---|
| 4,073,133 | 2/1978 | Earls et al. | 368/75 |
| 4,148,181 | 4/1979 | Scheere | 368/75 |
| 4,211,064 | 7/1980 | Ikeda et al. | 368/272 |
| 4,251,877 | 2/1981 | Scheer | 368/75 |

FOREIGN PATENT DOCUMENTS 1561070 2/1980 United Kingdom .

*Primary Examiner*—Bernard Roskoski

*Attorney, Agent, or Firm*—Bruce L. Adams; Van C. Wilks

[57] ABSTRACT

A clock has a set of clock hands driven in accordance with a time base signal to indicate time. The time base signal is counted by a resettable counter which produces a time count value on the quarter, half and three-quarter hours to activate a melody generating circuit. Each time the clock hands reach an hour position, an hour signal is generated and fed to an hour striking circuit. During time correction of the clock hands or when electric power is initially applied to the clock, the melody generating circuit is inhibited until the next hour signal is generated, thereby ensuring that a melody will only be generated when the time count of the counter coincides with the time indication of the clock hands.

19 Claims, 1 Drawing Sheet

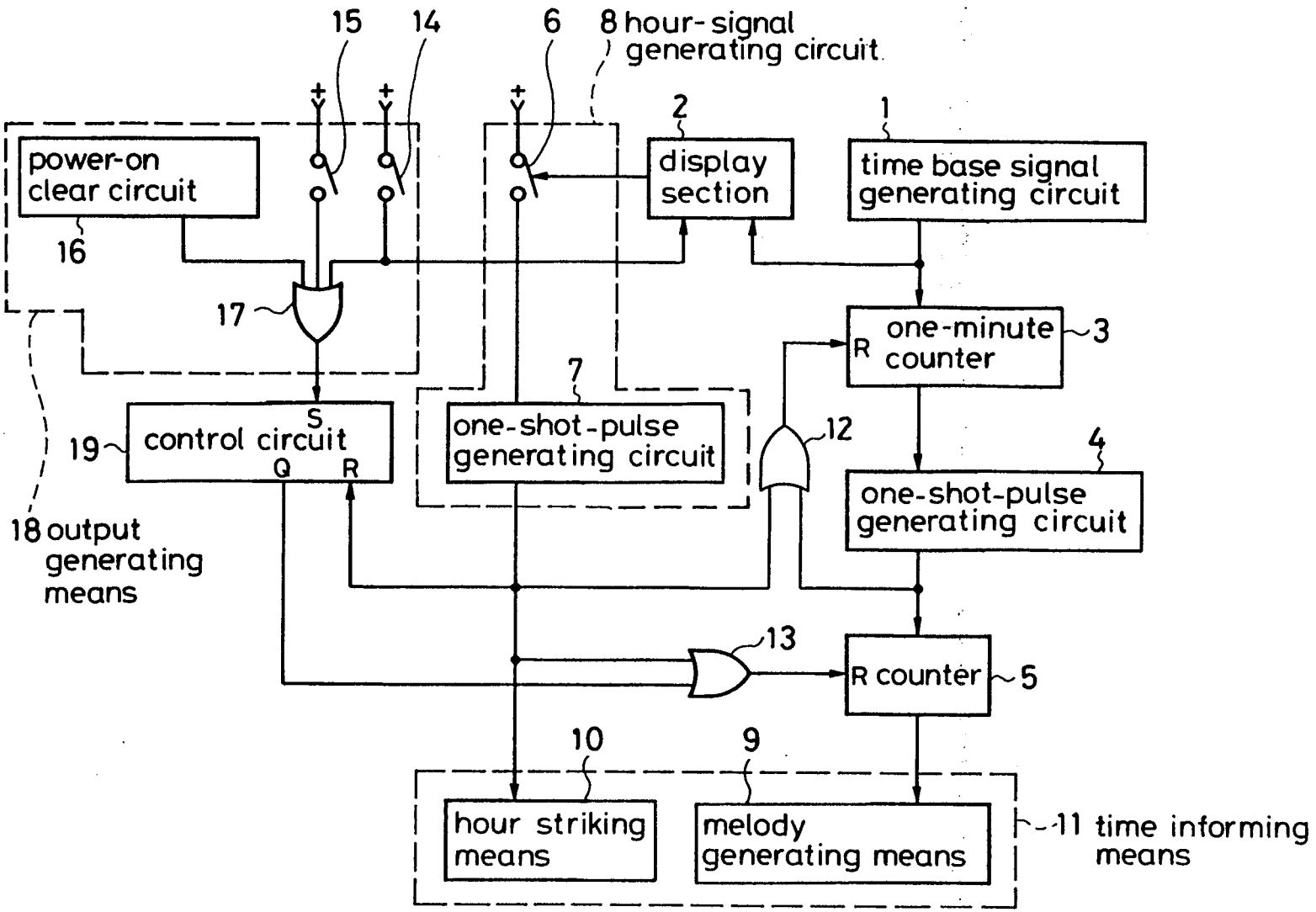
1
time base signal generating circuit
2
display section
3
one-minute counter
R
4
one-shot-pulse generating circuit
5
R counter
6
7
one-shot-pulse generating circuit
8 hour-signal generating circuit
9
melody generating means
10
hour striking means
11 time informing means
12
13
14
15
16
power-on clear circuit
17
S
R
Q
control circuit
19
18 output generating means

TIME INFORMING CLOCK

BACKGROUND

This invention relates to a time informing clock.

In the field of analog clocks capable of indicating time by means of clock hands, a time informing clock has been marketed which is capable of striking hours and performing different melodies correspondingly to the quarter, the half hour, and the three quarters, for example. This type of time informing clock operate in such a manner that the hour is detected by an hour switch which, in response to the operation of a minute hand, closes when the hour is reached to inform the hour. Additionally provided is a counter means which starts to count the time upon an hour signal being generated by the hour switch, whereby the quarter, the half hour, and the three quarters are determined to perform corresponding melodies.

In the foregoing conventional clock; the time indicated by the clock hands sometimes is different from the time count of the counter means. Since the counter means starts to count the time upon receipt of the hour signal, when the time indication of the clock is corrected, the time, indicated by the clock hands becomes different from the time count of the counter means; consequently, up to when the next hour is reached, individual melodies are performed at moments deviating from the quarter, the half hour, and the three quarters indicate-d by the minute hand.

SUMMARY OF THE INVENTION

It is an object of the present invention to provide a time informing clock capable of inhibiting a time informing operation when it is discord with the time indicated by clock hands.

To solve the aforementioned problems, the present invention provides a time informing clock which comprises a display means for indicating time by means of clock hands, a counter means for receiving a time base signal and counting the time, time informing means for informing at least on half hour and on the hour on the basis of the time count of the counter means, an hour-signal generating means for generating an hour signal and resetting the counter means each time the clock hands indicate the hour to make the counter means coincide with the indication of the clock hands, output generating means for generating an output when electric power is applied or when the time count of the counter means and the indication of the clock hands do not coincide, and control means for inhibiting the time informing operation of the time informing means from when the output is generated from the output generating means to when the hour signal is generated.

BRIEF DESCRIPTION OF THE DRAWING

The single FIGURE of drawing is an electric circuit diagram showing an embodiment of time informing clock according to the present invention.

DETAILED DESCRIPTION OF THE INVENTION

An embodiment of the present invention will now be described with reference to the drawing.

In the drawing, a time base signal generating circuit 1 including a crystal oscillator circuit, a frequency divider circuit and the like generates a clock signal of 1 Hz referred to as a time base signal. A display section 2 drives a set of clock hands in accordance with the time base signal from the time base signal generating circuit 1 to indicate time. A one-minute counter 3 counts the clock signal of 1 Hz from the time base signal generating circuit 1 and generates an output signal when one minute is counted, and a one-shot-pulse generating circuit 4 generates a one-shot-pulse every minute in response to the output signal from the one-minute counter 3. A counter 5 is provided for generating output signals correspondingly to when the quarter, the half hour, and the three quarters are counted on the basis of the pulses from the one-shot-pulse generating circuit 4. An hour switch 6 responds to the operation of the minute hand of the display section 2 and closes when the hour is reached to generate an hour signal, and a one-shot-pulse generating circuit 7 generates a one-shot-pulse upon receipt of the hour signal, the hour switch 6 and the circuit 7 constituting an hour-signal generating circuit 8. A melody generating means 9 is provided for generating different melodies upon receipt of the individual output signals from the counter 5, and an hour striking means for the strikes current hour upon receipt of the pulse from the one-shop-pulse generating circuit 7, the circuitry 9, 10 constituting a time informing means 11. 12 and 13 are gate circuits and 14 is a reset switch. When the reset switch 14 is closed, the rotation of each clock hand of the display section 2 stops. A time adjusting switch 15 closes in response to the operation of a time adjusting handle (not shown) for turning the clock hands when this handle is controlled for time correcting purposes. A power-on clear circuit generates a one-shot-pulse when electric power is applied, and 17 is a gate circuit. The components 14 through 17 constitute an output generating means 18. A control circuit 19 is made of a flip-flop circuit, which shifts to the set state upon receipt of the output signal of "1∞ from the gate circuit 17 and shifts to the reset state upon receipt of the output signal of "1" from the one-shot-pulse generating circuit 7.

The operation of the foregoing clock will be described next. Assume that the clock hands of the display section 2 indicate 9:10. First, when electric power is applied, the time base signal generating circuit 1 starts to generate the time base signal of 1 Hz, in response to which the clock hands of the display section 2 start to move and the one-minute counter 3 starts to count the time. Concurrently, the power-on clear circuit 16 generates a one-shot pulse, in response to which the output signal at terminal Q of the control circuit 19 becomes "1", and by means of the gate circuit 13, the counter 5 switches to the reset state. Therefore, the counter 5 executes no time counting and thus, no melody is generated from the melody generating means 9.

Then, when the time becomes 10:00, the hour switch 6 closes, so that a one-shot pulse is generated from the one-shot-pulse generating circuit 7. Consequently, the one-minute counter 3 and the counter 5, are reset. Concurrently, the control circuit 19 switches to the reset state so that the output signal of its terminal Q becomes "0"; as a result, the counter 5 starts to count the time. That is, as soon as the hour is reached, the one-minute counter 3 and the counter 5 start to count the time. On the other hand, a one-shot pulse is supplied from the one-shot-pulse generating circuit 7 to the hour striking means 10, so that hour striking is executed a definite number of times corresponding to the hours displayed in the display section 2. In the foregoing example, hour striking is executed ten times.

Then, when the time becomes 10:15, 10:30, and 10:45, the corresponding output signals are generated from the counter 5, so that different melodies are generated from the melody generating means 9.

Then, if the reset switch 14 is closed when the time is 11:10, for example, for the purpose of correcting the second hand, the rotation of the clock hands stops, the output signal at terminal Q of the control circuit 19 becomes "1", and the counter 5 switches to the reset state. Even if the reset switch 14 is opened, this state is preserved until the control circuit 19 is reset by the next hour signal. That is, no time informing is executed up to the next hour, namely, until the time becomes 12:00. Therefore, even when the reset switch 14 is controlled to stop the rotation of the clock hands, time informing is never executed under the condition that the time indicated by the clock hands is not in accord with the time count of the counter 5.

Then, when the time adjusting handle is controlled to turn the minute and second hands for time correcting purposes, in response to the control operation, the time adjusting switch 15 is closed, and the control circuit 19 switches to the set state. In this case, in which similarly to the case the reset switch 14 is closed, the time informing operation is inhibited until the next hour is reached.

In this way, when electric power is applied or when the time indicated by the clock hands is different from the time count of the counter 5, the time informing operation is inhibited until the next hour is reached.

Although the foregoing embodiment generates the output signals corresponding to when the counter 5 counts the quarter, the half hour, and the three quarters, the present invention should not be limited to such a system and may be modified such that the output signal is generated only at the half hour, for example.

Although the foregoing embodiment inhibits the time informing operation by keeping the counter 5 in the reset state, the present invention should not be limited to such a system and may be modified such that the time informing action is inhibited by directly keeping the time informing means 11 in a disabled state.

According to the present invention, when electric power is applied and when the time is corrected, the time informing operation is inhibited until the next hour is reached; therefore, time informing is never executed under the condition that the time indicated by the clock hands is not in accord with the time count of the counter, whereby time informing is always executed at the correct timing.

I claim:

1. A time informing clock comprising: display means for indicating time by means of clock hands, counter means for receiving a time base signal and counting the time, time informing means for informing at least on the half hour and on the hour on the basis of the time count of the counter means, hour-signal generating means for generating an hour signal and resetting the counter means each time the clock hands indicate the hour to make the time count of the counter means coincide with the time indication of the clock hands, output generating means for generating an output when electric power is applied to the clock or when the time count of the counter means and the time indication of the clock hands are different, the output generating means including switch means for generating an output to inhibit operation of the time informing means during time correction of the clock hands, and control means for inhibiting the time informing operation of the time informing means from when the output is generated from the output generating means to when the hour signal is generated.

2. A time information clock according to claim 1; wherein the time informing means includes hour striking means for striking the hour each time the hour signal is generated.

3. A time informing clock according to claim 2; wherein the time informing means includes melody generating means for generating a melody on the half hour.

4. A time informing clock according to claim 2; wherein the time information means includes melody generating means for generating a melody on the quarter, half and three-quarter hours.

5. A clock comprising: means for generating a time base signal; time-indicating means including a set of clock hands for indicating time in accordance with the time base signal; resettable counting means for counting the time base signal; hour-signal generating means for generating an hour signal each time the clock hands indicate the hour and applying the hour signal to the counting means to reset the same so that the time count of the counting means coincides with the time indicated by the clock hands; time-informing means responsive to the hour signal for informing on the hour and responsive to the time count of the counting means for informing on the half hour; and means for inhibiting the time informing operation of the time-informing means during time correction of the clock hands and until the next hour signal is generated after completion of the time correction.

6. A clock according to claim 5; wherein the means for inhibiting comprises means for inhibiting operation of the counting means.

7. A clock according to claim 6; wherein the means for inhibiting operation of the counting means comprises means for maintaining the counting means in a reset state.

8. A clock according to claim 5; wherein the time-informing means includes hour striking means for striking the hour.

9. A clock according to claim 8; wherein the time-informing means includes melody generating means for generating a melody on the half hour.

10. A clock according to claim 8; wherein the time-informing means includes melody generating means for generating a melody on the quarter hour, the half hour and the three-quarter hour.

11. A clock according to claim 5; wherein the time-informing means includes melody generating means for generating a melody on the half hour.

12. A clock according to claim 5; wherein the time-informing means includes melody generating means for generating a melody on the quarter hour, the half hour and the three-quarter hour.

13. A clock according to claim 5; wherein the means for inhibiting comprises output generating means for generating an output signal when time correction of the clock hands is initiated, and control means responsive to the output signal for inhibiting the time informing operation of the time-informing means until generation of the next hour signal after completion of the time correction.

14. A clock according to claim 13; wherein the output generating means further includes means for generating an output signal when electric power is initially applied to the clock.

15. A clock according to claim 14; wherein the time-informing means includes hour striking means for striking the hour.

16. A clock according to claim 15; wherein the time-informing means includes melody generating means for generating a melody on the half hour.

17. A clock according to claim 13; wherein the time-informing means includes hour striking means for striking the hour.

18. A clock according to claim 14; wherein the time-informing means includes melody generating means for generating a melody on the half hour.

19. A clock according to claim 19; wherein the time-informing means includes melody generating means for generating a melody on the quarter hour, the half hour and the three-quarter hour.

* * * * *